US007493068B2

(12) United States Patent
Tatsumi et al.

(10) Patent No.: US 7,493,068 B2
(45) Date of Patent: Feb. 17, 2009

(54) DEVELOPING UNIT WITH AGITATION TRANSPORT MEMBERS

(75) Inventors: Eiji Tatsumi, Osaka (JP); Takahisa Nakaue, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 137 days.

(21) Appl. No.: 11/380,424

(22) Filed: Apr. 27, 2006

(65) Prior Publication Data

US 2006/0245792 A1 Nov. 2, 2006

(30) Foreign Application Priority Data

Apr. 28, 2005 (JP) ..... 2005-133092

(51) Int. Cl.
*G03G 15/08* (2006.01)

(52) U.S. Cl. ..... 399/254; 399/255; 399/256; 399/263

(58) Field of Classification Search ..... 399/252, 399/254–256, 263
See application file for complete search history.

(56) References Cited

U.S. PATENT DOCUMENTS 5,436,703 A * 7/1995 DeYoung et al. ..... 399/256
5,963,766 A * 10/1999 Okuno et al. ..... 399/256

FOREIGN PATENT DOCUMENTS

| | | |
|---|---|---|
| JP | H08-044208 A | 2/1996 |
| JP | 9/160360 A | 6/1997 |
| JP | 2002-148916 A | 5/2002 |

* cited by examiner

*Primary Examiner*—David M Gray
*Assistant Examiner*—Ruth N Labombard
(74) *Attorney, Agent, or Firm*—Global IP Counselors, LLP

(57) ABSTRACT

A developing unit is disclosed in which replenished toner is smoothly transported and efficiently agitated into the developing unit by an agitation transport member provided therein having a supply region formed upstream from a transport region. A first agitation transport screw installed in a developing unit includes a developer transport region to transport developer downstream thereof, and a toner supply region that is formed coaxially with the developer transport region and upstream of the developer transport region, and supplies the externally replenished toner to the developer transport region. Moreover, a gap formed between the toner supply region and a region of the housing in the toner supply region is smaller than a gap formed between the developer transport region and a region of the housing in the developer transport region.

13 Claims, 2 Drawing Sheets

DEVELOPING UNIT WITH AGITATION TRANSPORT MEMBERS

CROSS-REFERENCE TO RELATED APPLICATIONS

This application claims priority to Japanese Patent Application No. 2005-133092. The entire disclosure of Japanese Patent Application No. 2005-133092 is hereby incorporated herein by reference.

BACKGROUND OF THE INVENTION

1. Field of the Invention

The present invention relates to a developing unit. More specifically, the present invention relates to a developing unit that provides developer to the surface of a developer support member installed in an image forming device.

2. Background Information

An electrophotographic image forming device such as a laser printer or a copying machine has a photosensitive drum and a developing unit that provides toner to the surface of the photosensitive drum. In general, the developing device includes a developing roller that provides toner to the photosensitive drum, an agitation transport member that agitates the developer and simultaneously transports the developer in the axial direction and provides the same to the developing roller, and a housing which includes the developing unit and the agitation transport member in the interior thereof. The agitation transport member is normally comprised of a rotary shaft, and a helical blade that is formed on the outer circumference of the rotary shaft.

An example of the conventional developing unit is disclosed in Japan Patent Application Publication JP-A-09-160360. The circulation agitation method is used in this developing unit, and developer is circulated and agitated by two agitation transport members that are arranged parallel to each other. In addition, a toner replenishment hole is formed in a region of the housing located between both ends thereof in the axial direction of the agitation transport members. Furthermore, an external diameter "R" of one region of a blade formed on one agitation transport member which faces this toner replenishment hole, is formed to be larger than an external diameter "r" of another region of the blade formed on the agitation transport member. Thus, the replenished toner can be efficiently agitated into the developer.

However, a gap "g" formed between the agitation transport member and the housing in regions except for the vicinity of the toner replenishment hole has to be formed to have a length that is at least half of the difference between the external diameter "R" and the external diameter "r" of the blade (i.e., at least $(R-r)/2$). Therefore, the gap between the blade and the housing in regions except for the vicinity of the toner replenishment hole will inevitably be larger. Thus, agitation/transport efficiency is significantly reduced.

On the other hand, the gap "G" between the agitation transport member and the housing in the vicinity of the toner replenishment hole cannot be set smaller than this value, in order to avoid contact between the agitation transport member and the housing caused by the deflection of the rotary wobbling of the agitation transport member in the radial direction.

A developing unit using a conventional circulation agitation method has been proposed, in which one of the agitation transport members is formed to be longer than the other agitation transport member in the axial direction. Here, a portion of the longer agitation transport member is used as a toner supply region containing externally replenished toner. In this unit, toner is transported from the toner replenishment region to the toner supply region located downstream of the toner replenishment region, and is circulated and transported between the longer agitation transport member and the other agitation transport member.

In view of the above, it will be apparent to those skilled in the art from this disclosure that there exists a need for an improved developing unit. This invention addresses this need in the art as well as other needs, which will become apparent to those skilled in the art from this disclosure.

SUMMARY OF THE INVENTION

It is therefore an object of the present invention to provide a developing unit comprising an agitation transport member that has a supply region upstream of the transport region, and which allows the replenished toner is to be smoothly and efficiently agitated and transported into the developer.

In accordance with a first aspect of the present invention, a developing unit that supplies developer to the surface of a developer support member installed in an image forming device is comprised of a first agitation transport member that is comprised of (a) a rotary shaft, and (b) a helical blade formed on the outer circumference of the rotary shaft. The first agitation transport member also includes a transport region configured to transport developer to one side in the axial direction, and a supply region arranged upstream of the transport region to be coaxial with the transport region and configured to supply externally replenished toner to the transport region. The developing unit also includes a housing in which the first agitation transport member is rotatably arranged in the interior thereof. Here, a first gap in the radial direction formed between an outer circumferential portion of the supply region of the first agitation transport member and an inner circumferential portion of the housing facing the supply region, is smaller than a second gap in a radial direction formed between an outer circumferential portion of the transport region of the first agitation transport member and an inner circumferential portion of the housing facing the transport region.

According to the first aspect of the present invention, the developer is first supplied to the supply region located upstream of the transport region on the first agitation transport member. Next, the toner moves downstream of the supply region in the first agitation transport member by means of a blade that rotates around the rotary shaft. Thus, toner is transported to the transport region and further downstream of the transport region. Here, the first gap formed between the supply region and the housing is formed to be smaller than the second gap formed between the transport region and the housing.

The supply region is located at an end of the housing in the axial direction. In other words, the supply region can be located in the vicinity of the bearing of the first agitation transport member. Therefore, even if a structure in which the first gap is formed to be smaller than the second gap is applied to a developing unit, it is possible to avoid contact between the first agitation transport member and the housing, which is caused by the rotary wobbling of the blade. Therefore, it will not be necessary to take countermeasures such as enlarging the diameter of the rotary shaft, using a material having a high degree of stiffness for the first agitation transport member, or the like. Accordingly, it is possible to avoid an increase in costs.

In addition, according to the first aspect of the present invention, the first gap is formed to be smaller than the second gap in this developing unit. Therefore, it is possible to transport all the replenished developer to the transport region from the supply region. Furthermore, reflux of the developer into the supply region from the transport region can be inhibited, as well as stasis of the developer in the vicinity of the boundary between the transport region and the supply region.

In addition, in the first aspect of the present invention, the term "inner diameter" with regard to the housing means a shape having a circular arc portion in a portion of a circumferential region thereof. Therefore, it does not necessarily mean that the subject region is a continuous shape in the entire circumferential direction.

Furthermore, not only a two-component developer, but also a one-component developer can be used in the developing unit.

In accordance with a second aspect of the present invention, in the developing unit according to the first aspect of the present invention, the inner diameter of the inner circumferential portion of the housing facing the supply region of the first agitation transport member is formed to be smaller than the inner diameter of the inner circumferential portion of the housing facing the transport region of the first agitation transport member.

In accordance with a third aspect of the present invention, in the developing unit according to the first aspect of the present invention, the length of a step member formed in the radial direction between the inner circumferential portion of the housing facing the supply region and the inner circumferential portion of the housing facing the transport region is equal to or greater than the length of the second gap.

In accordance with a fourth aspect of the present invention, in the developing unit according to the first aspect of the present invention, the helical pitch of the supply region of the first agitation transport member is formed to be smaller than that of the transport region of the first agitation transport member.

According to the fourth aspect of the present invention, the developer is transported in the supply region at a low speed, and transported in the transport region at a high speed. Therefore, it is possible to avoid a situation in which the transport region is clogged with toner and thus making it difficult for toner to be supplied from the supply region to the transport region.

In accordance with a fifth aspect of the present invention, a developing unit according to the first aspect of the present invention further comprises a second agitation transport member that is arranged parallel to the first agitation transport member, the second agitation transport member having a length in the axial direction that corresponds to the length of the transport region of the first agitation transport member; and a bulkhead member that is arranged between the first agitation transport member and the second agitation transport member and connects the first agitation transport member side and the second agitation transport member side at both ends of the second agitation transport member in the axial direction.

According to the fifth aspect of the present invention, the same effects can be achieved as with the developing unit in accordance with the first aspect of the present invention, especially when a circulation agitation method performed by two agitation transport members is applied to the developing unit.

As described above, according to the present invention, the supply region can be arranged in the vicinity of the bearing of the first agitation transport member by arranging the supply region at one end of the first agitation transport member in the axial direction. Therefore, even if a structure in which the first gap is formed to be smaller than the second gap is applied to a developing unit, it is possible to prevent the first agitation transport member from coming into contact with the housing, which is caused by the rotary wobbling of the blade. Therefore, it is not necessary to enlarge the diameter of the rotary shaft, use a highly stiff material for the first agitation transport member, or the like. Thus, it is possible to avoid an increase in costs.

In addition, according to the present invention, the first gap is formed to be smaller than the second gap. Therefore, it is possible to transport all the replenished developer to the transport region from the supply region. Furthermore, this configuration will inhibit the reflux of the developer into the supply region from the transport region, and stasis of the developer in the vicinity of the boundary between the transport region and the supply region.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
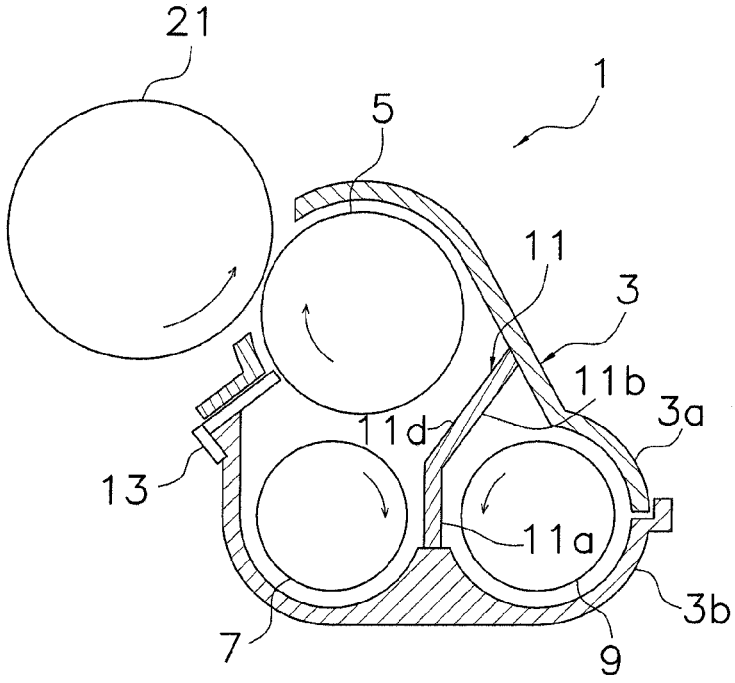
FIG. 1 is a vertical cross-section diagram showing a developing unit in accordance with a first embodiment of the present invention.
Figure 2:
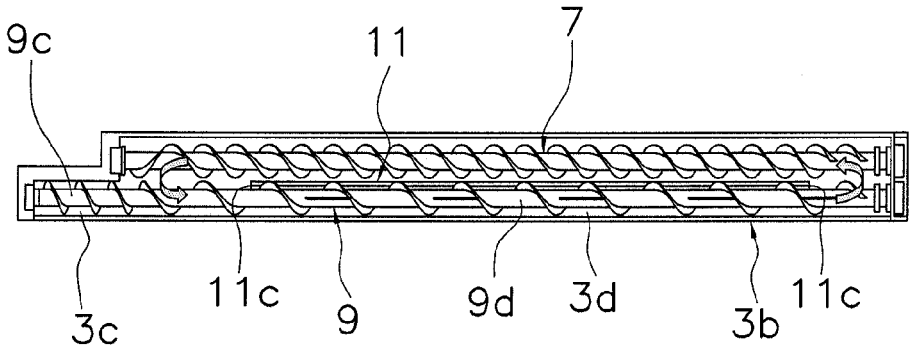
FIG. 2 is a top perspective view showing a portion of the interior of the developing unit in accordance with the first embodiment of the present invention.

FIGS. 1 and 2 show diagrams of a developing unit 1 in accordance with a first embodiment of the present invention.

The developing unit 1 is installed in a tandem full color printer (not shown in the figures), and arranged adjacent to a photosensitive drum 21 (a developer support member) installed in the full color printer. The developing unit 1 is comprised of a housing 3, a developing roller 5, a first agitation transport screw 9 (a first agitation transport member 9), a second agitation transport screw 7 (a second agitation transport member 7), a bulkhead 11, andablade 13.

The housing 3 is a member comprising the chassis of the developing unit 1. The housing 3 is primarily comprised of an upper housing member 3*a*, and a lower housing member 3*b* attached to the upper housing member 3*a*. In addition, the developing roller 5, the second agitation transport screw 7, and the first agitation transport screw 9 are rotatably arranged in the interior of the housing 3, and the bulkhead 11 is fixed in the interior of the housing 3. Furthermore, two-component developer is placed in the interior of the housing 3.

The lower housing member 3*b* includes a region 3*c* that faces a toner supply region 9*c*, and a region 3*d* that faces a developer transport region 9*d* in a region in which the first agitation transport screw 9 is arranged. Here, a gap "G" (hereinafter referred to as a first gap G) formed between the toner supply region 9*c* and the region 3*c* in the radial direction is formed to be smaller than a gap "g" (hereinafter referred to as a second gap g) formed between the developer transport region 9*d* and the region 3*d* in the radial direction. In addition, an inner diameter "D" of the region 3*c* is formed to be smaller than an inner diameter "d" of the region 3*d*, and a step member 3*e* is formed in the boundary between the region 3*c* and the region 3*d*. The step member 3*e* is formed to have at least the same length as the second gap g. Further, the step member 3*e* formed in the interior of the housing 3 is preferably set to be larger than the second gap "g" in the developer transport region 9*d*. More specifically, the region 3*c* is preferably set to have an inner diameter "D" of 17 mm, and the region 3*d* is set to have an inner diameter "d" of 20 mm.

The developing roller 5 is a rotational body which can attract toner onto its surface. Five magnetic poles including a drawing magnetic pole and a peel-off magnetic pole (not shown in the figures) are fixed in the interior of the developing roller 5. In addition, the developing roller 5 is arranged in the interior of the housing 3 so that its lower end is located above the upper ends of the agitation transport screws 7 and 9 and its rotary shaft is located between the agitation transport screws 7 and 9 in the horizontal direction.

The first agitation transport screw 9 is arranged parallel to the second agitation transport screw 9 in the horizontal direction. It circulates and transports developer in cooperation with the second agitation transport screw 7, and mixes the developer contained in the housing 3 with toner replenished from a hopper (not shown in the figures) installed in the full color printer. Here, toner is replenished from the hopper through a toner supply region 9*c*.

The first agitation transport screw 9 is comprised of a rotary shaft 9*a*, and a helical blade 9*b* formed on the outer circumference of the rotary shaft 9*a*. In addition, the first agitation transport screw 9 can be divided into a developer transport region 9*d* and a toner supply region 9*c*. The developer transport region 9*d* transports the developer to the downstream side thereof (i.e., to the right side of FIG. 2). On the other hand, the toner supply region 9*c* is arranged adjacent to and coaxially with the developer transport region 9*d*. In other words, the toner supply region 9*c* is arranged on the upstream side of the developer transport region 9*d*, and supplies the toner replenished from the hopper to the developer transport region 9*d*.

The first agitation transport screw 9 has an outer diameter "R" of 16 mm in the toner supply region 9*c*, and an outer diameter "r" of 18 mm in the developer transport region 9*d*. In addition, the screw pitch in the toner supply region 9*c* is smaller than that of the developer transport region 9*d*. Here, the screw pitch of the developer transport region 9*d* is set to 30 mm, and set to 15 mm in the toner supply region 9*c*. In addition, the screw revolution speed is set to 180 rpm.

The second agitation transport screw 7 is a member that simultaneously agitates and transports the developer in the axial direction, and supplies the developer to the developing roller 5. The second agitation transport screw 7 has a length corresponding to the developer transport region 9*d* of the first agitation transport screw 9 in the axial direction, and is arranged to face the developer transport region 9*d*.

Here, the first and the second agitation transport screws 9 and 7 are rotatably supported by bearings (not shown in the figures) at both ends thereof in the axial direction.

Figure 3:
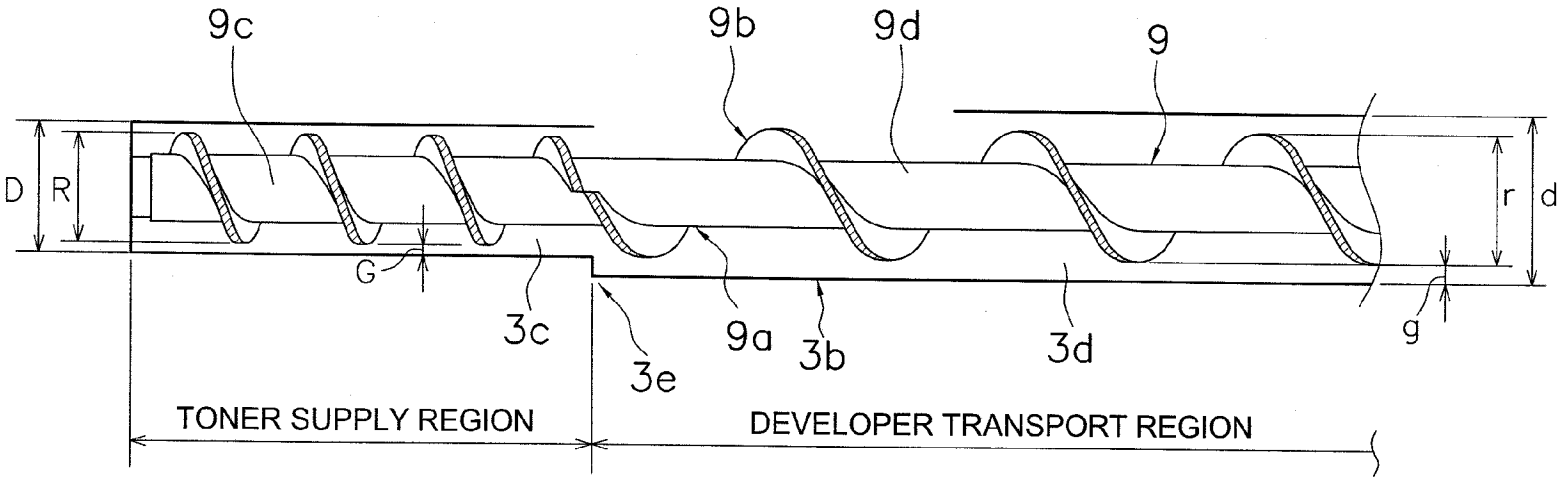
FIG. 3 is an enlarged partial view of FIG. 2 showing the main portion of the developing unit.

The bulkhead 11 comprises a partition member 11*a* and a guide member 11*b*. The partition member 11*a* divides the two agitation transport screws 7 and 9 in the horizontal direction, and the guide member 11*b* guides the toner that has been peeled off from the developing roller 5 to the second agitation transport screw 7 side. Here, the partition member 11*a* is arranged between the second agitation transport screw 7 and the first agitation transport screw 9 in the horizontal direction. The partition member 11*a* is connected to the housing 3 between the second agitation transport screw 7 and the first agitation transport screw 9 in the horizontal direction. In addition, as shown in FIGS. 2 and 3, openings 11*c* are formed on both ends of the partition member 11*a* in the axial direction. The openings 11*c* connect the second agitation transport screw 7 side with the first agitation transport screw 9 side.

The guide 11*b* has a sloping surface 11*d* that guides developer that has been peeled off from the surface of the developing roller 5 to the second agitation transport screw 7 side. The guide 11*b* is connected to the housing 3 on a portion opposite the connection of the partition member 11*a* and the housing 3 between the first agitation transport screw 9 and the developing roller 5.

The blade 13 controls the thickness of the layer of toner to be peeled off from the developing roller 5.

Next, the operation of the developing unit 1 will be described in detail below.

When the color printer receives a command to perform an image forming operation, the developer contained in the housing 3 is drawn by the developing roller 5 and the blade 13 controls the thickness of the layer of the developer thereon. Then, a portion of the developer is supplied to the photosensitive drum 21 from the developing region.

The developer remaining on the developing roller 5 is peeled off from the developing roller 5 after passing the developing region. The developer then drops onto the sloping surface 11*d* of the bulkhead 11, and is guided to the first agitation transport screw 7 side by the sloping surface 11*d*.

The retrieved developer is circulated and transported in the interior of the housing 3 through the openings 11*c* formed on the bulkhead 11 by the rotary drive of the second agitation transport screw 7 and the first agitation transport screw 9, and mixed with the toner replenished from the hopper in the first agitation transport member 9.

As described above, according to the first embodiment of the present invention, the developing unit 1 is formed so that the outer diameter "R" of the toner supply region 9*c* and the inner diameter "r" of the corresponding region 3*c* are set to be small, and the step member 3*e* formed in the interior of the housing 3 is preferably set to be larger than the second gap "g" in the developer transport region 9*d*. Therefore, it is possible to prevent the first agitation transport screw 9 from coming into contact with the housing 3 due to rotary wobbling of the blade 9*b*. Accordingly, it will not be necessary to take countermeasures such as enlarging the diameter of the rotary shaft 9*a*, using material having a high degree of stiffness, or the like, with respect to the first agitation transport screw 9. Thus, it will be possible to avoid an increase in costs.

In addition, according to the first embodiment of the present invention, the developing unit 1 is formed so that the first gap "G" is formed to be smaller than the second gap "g." Therefore, it is possible to transport all the replenished toner to the developer transport region 9*d* without leaving any in the toner supply region 9*c*. Furthermore, it is possible to reliably avoid the reflux of developer into the toner supply region 9*c* from the developer transport region 9*d*, and developer stasis in the vicinity of the step member 3*e*.

Second Embodiment

A second embodiment of the present invention will now be described by focusing on the differences between the first and the second embodiments of the present invention. In view of the similarity between the first and second embodiments, the parts in the second embodiment that are identical to the parts in the first embodiment will be given the same reference numerals as the parts in the first embodiment. Moreover, the descriptions of the parts of the second embodiment that are identical to the parts of the first embodiment will be omitted for the sake of brevity.

In the second embodiment of the present invention, the outer diameter "R" of the toner supply region 9*c* and the outer diameter "r" of the developer transport region 9*d* are set to be the same in the first agitation transport screw 9. On the other hand, the inner diameter "D" of the region 3*c* facing the toner supply region 9*c* is set to be smaller than the inner diameter "d" of the developer transport region 9*d* in the housing 3. Therefore, the gap "G" formed between the first agitation transport screw 9 and the housing 3 is formed to be small.

More specifically, the outer diameter "R" and "r" of the first agitation transport screw 9 are set to 18 mm. On the other hand, the inner diameter "D" of the housing 3 is set to be 19 mm, and the inner diameter "d" of the housing 3 is set to be 20 mm. In addition, the screw pitch of the developer transport region 9*d* is set to 30 mm and that of the toner supply region 9*c* is set to 15 mm. Furthermore, the screw revolution speed is set to 180 rpm.

Third Embodiment

A third embodiment of the present invention will now be described by focusing on the differences between this embodiment and the first and second embodiments of the present invention described above. In view of the similarities between the first, the second, and the third embodiments, the parts in the third embodiment that are identical to the parts in the first and the second embodiments will be given the same reference numerals as the parts in the first and the second embodiments. Moreover, descriptions of the parts of the third embodiment that are identical to the parts of the first and the second embodiments will be omitted for the sake of brevity.

According to the third embodiment of the present invention, the inner diameter "D" of the region 3*c* in the housing 3 and the inner diameter "d" of the region 3*d* in the housing 3 are set to be the same. On the other hand, the outer diameter "R" of the toner supply region 9*c* is set to be larger than the outer diameter "r" of the developer transport region 9*d* in the first agitation transport screw 9. Therefore, the gap "G" formed between the first agitation transport screw 9 and the housing 3 is set to be small.

More specifically, the inner diameter "D" of the housing 3 and the inner diameter "d" of the housing 3 are set to be 20 mm. On the other hand, the outer diameter "R" of the first agitation transport screw 9 is set to be 19 mm and the outer diameter "r" of the first agitation transport screw 9 is set to 18 mm. In addition, the screw pitch of the developer transport region 9*d* is set to 30 mm, and that of the toner supply region 9*c* is set to 15 mm. Furthermore, the screw revolution speed is set to 180 rpm.

Modifications

The specific dimensions of the components in the developing unit are not limited to the above described specific dimensions in the above described embodiments. In addition, the positional relationship between the developing roller and the agitation transport member in the developing unit is not limited to those described in the above described embodiments. Furthermore, the developing unit is not limited to the type of developing unit in which the circulation agitation method is used. For example, it may be a developing unit in which one agitation transport member is installed therein. Moreover, the developing unit is not limited to a unit in which a two-component developer is used. For example, it may be a developing unit in which a one-component developer is used. In addition, it is possible to apply the developing unit in accordance with the present invention to not only a tandem color printer, but also to other electrophotographic image forming devices such as a one-drum color printer or a monochrome laser printer.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing unit configured to supply developer to the surface of a developer support member installed in an image forming device, comprising:

a first agitation transport member comprising a rotary shaft, a helical blade formed on the outer circumference of the rotary shaft, a transport region configured to transport developer to one side in the axial direction, and a supply region arranged upstream of the transport region to be coaxial with the transport region and configured to supply externally replenished toner to the transport region;

a second agitation transport member;

a housing in which the first and second agitation transport members are rotatably arranged in the interior thereof, a first gap in the radial direction formed between an outer circumferential portion of the supply region of the first agitation transport member and an inner circumferential portion of the housing facing the supply region being smaller than a second gap in a radial direction formed between an outer circumferential portion of the transport region of the first agitation transport member and an inner circumferential portion of the housing facing the transport region; and a bulkhead member being arranged between the first agitation transport member and the second agitation transport member, and the bulkhead member having openings connecting the first agitation transport member side and the second agitation transport member side at both ends of the second agitation transport member in the axial direction, the bulkhead member also having a partition member being connected to the housing and dividing the first agitation member and the second agitation member in a horizontal direction, and a guide being connected to the housing on a portion opposite the connection of the partition member.

2. The developing unit according to claim 1, wherein the inner diameter of the inner circumferential portion of the housing facing the supply region of the first agitation transport member is formed to be smaller than the inner diameter of the inner circumferential portion of the housing facing the transport region of the first agitation transport member.

3. The developing unit according to claim 1, wherein the length of a step member formed in the radial direction between the inner circumferential portion of the housing facing the supply region and the inner circumferential portion of the housing facing the transport region is equal to or greater than the length of the second gap.

4. The developing unit according to claim 1, wherein the helical pitch of the supply region of the first agitation transport member is formed to be smaller than that of the transport region of the first agitation transport member.

5. The developing unit according to claim 1, wherein the second agitation transport member is arranged parallel to the first agitation transport member and the second agitation transport member has a length in the axial direction that corresponds to the length of the transport region of the first agitation transport member.

6. The developing unit according to claim 1, wherein a screw pitch of the transport region of the first agitation transport member is set to be twice as long as that of the supply region of the first agitation transport member.

7. The developing unit according to claim 6, wherein the outer diameter of the outer circumferential portion of the supply region of the first agitation transport member and the outer diameter of the outer circumferential portion of the transport region of the first agitation transport member are set to be the same length.

8. The developing unit according to claim 7, wherein the inner diameter of the inner circumferential portion of the supply region of the housing facing the supply region of the first agitation transport member is smaller than the inner diameter of the inner circumferential portion of the transport region of the housing facing the transport region of the first agitation transport member.

9. The developing unit according to claim 1, further comprising a developing roller and wherein the guide is arranged between the first agitation transport member and the developing roller to guide developer that has been peeled off from the surface of the developing roller to the second agitation transport member.

10. The developing unit according to claim 9, wherein the guide has a sloping surface relative to the partition member.

11. The developing unit according to claim 1, wherein the outer diameter of the outer circumferential portion of the supply region of the first agitation transport member and the outer diameter of the outer circumferential portion of the transport region of the first agitation transport member are set to be the same length.

12. The developing unit according to claim 1, wherein the outer diameter of the outer circumferential portion of the supply region of the first agitation transport member is smaller than the outer diameter of the outer circumferential portion of the transport region of the first agitation transport member.

13. The developing unit according claim 1, wherein the inner diameter of the inner circumferential portion of the housing facing the supply region and the inner diameter of the inner circumferential portion of the housing facing the transport region are set to be the same.

* * * * *